US008689974B2

(12) United States Patent
Riad

(10) Patent No.: US 8,689,974 B2
(45) Date of Patent: Apr. 8, 2014

(54) ARTICLE SORTING APPARATUS

(75) Inventor: Andrew N. Riad, Raleigh, NC (US)

(73) Assignee: CreateSmart, LLC, Cary, NC (US)

( * ) Notice: Subject to any disclaimer, the term of this patent is extended or adjusted under 35 U.S.C. 154(b) by 194 days.

(21) Appl. No.: 13/180,682

(22) Filed: Jul. 12, 2011

(65) Prior Publication Data

US 2013/0015087 A1 Jan. 17, 2013

(51) Int. Cl.
*B65D 6/00* (2006.01)

(52) U.S. Cl.
USPC .. 206/278; 220/23.86; 220/4.03; 220/495.11; 220/676; 220/756; 280/47.17; 280/47.34; 280/651; D32/35; D32/61; 24/306; 24/545

(58) Field of Classification Search
USPC ..... 206/278; 211/113, 200, 85.24; 220/23.86, 4.03, 495.06, 495.11, 676, 220/756, 771; 24/306, 545; 280/47.17, 280/47.34, 651; D32/35, 61
See application file for complete search history.

(56) References Cited

U.S. PATENT DOCUMENTS

| | | | | |
|---|---|---|---|---|
| 2,793,762 | A * | 5/1957 | Broussard | 211/113 |
| 3,688,348 | A | 9/1972 | Klotz et al. | |
| 3,972,094 | A * | 8/1976 | Fuller | 211/85.3 |
| 4,939,823 | A | 7/1990 | Klein | |
| 5,234,139 | A * | 8/1993 | Korenstein | 223/85 |
| 5,357,660 | A | 10/1994 | Smith | |
| 5,667,081 | A * | 9/1997 | Pund-Hogan | 211/10 |
| 5,904,279 | A | 5/1999 | Bertram et al. | |
| 6,161,263 | A * | 12/2000 | Anderson | 24/545 |
| 6,237,158 | B1 | 5/2001 | Barbara | |
| 6,463,636 | B1 | 10/2002 | Friedewald | |
| 6,557,081 | B2 * | 4/2003 | Hill et al. | 711/137 |
| 6,769,555 | B2 * | 8/2004 | Brady | 211/85.3 |
| 8,348,054 | B2 * | 1/2013 | Dragan | 206/292 |
| 2004/0154075 | A1 | 8/2004 | Ferguson | |
| 2005/0126960 | A1 | 6/2005 | Aas et al. | |
| 2006/0093243 | A1 | 5/2006 | Murphy | |
| 2007/0150091 | A1 | 6/2007 | Griffits | |
| 2008/0301856 | A1 | 12/2008 | Errigo | |

FOREIGN PATENT DOCUMENTS

| | | | |
|---|---|---|---|
| EP | 0818571 | A2 | 1/1998 |
| WO | 2007138629 | A1 | 6/2007 |

OTHER PUBLICATIONS

International Search Report and Written Opinion mailed Oct. 18, 2012 for related application PCT/US12/43532, filed Jun. 21, 2012.

* cited by examiner

*Primary Examiner* — Anthony Stashick
*Assistant Examiner* — Cynthia Collado
(74) *Attorney, Agent, or Firm* — NK Patent Law, PLLC

(57) ABSTRACT

An article sorting apparatus is provided. The apparatus includes a container having a bottom and a longitudinally extending sidewall extending therefrom and a panel positioned proximal the container. The panel includes a cylindrically shaped shoulder extending therefrom and that defines a channel in alignment with the shoulder and that extends through the panel for allowing pass-through of a matched pair of socks. The cylindrically shaped shoulder is configured for receiving an open end of a first sock. A second sock is positioned proximal the first sock and inserted into and through a respective channel and disposed into the container.

16 Claims, 8 Drawing Sheets

ARTICLE SORTING APPARATUS

TECHNICAL FIELD

The subject matter disclosed herein is directed towards an article sorting apparatus, and more particularly, towards an article sorting and matching apparatus for matching articles of clothing such as socks.

BACKGROUND

Sorting articles such as garments and other clothing is a tedious and time consuming process. For example, sorting socks requires that a person sorts each individual sock while looking for a match to that sock. In order to find matches, the person may lay all of the socks on a nearby structure such as a table or floor, and then individually select matching pairs of socks. The matched pair of socks are then typically placed into a laundry basket and stored in an appropriate place.

Apparatuses have been developed to aid in sorting and matching garments such as socks. For example, apparatuses have been developed that compare the size and colors of articles of clothing such as socks in order to sort and match the socks. These apparatuses are expensive and impractical for most users. Additionally, various improvements to garments have been developed to help aid in sorting and matching garments such as socks. For example, some garments have print indicia at a predetermined location on the garment for matching garments. The print indicia for each garment is then compared with each other garment's print indicia to find a match. This system detracts from the aesthetic qualities of the garments.

Accordingly, a need exists for an apparatus or device that addresses the problems associated with conventional apparatus and methods for sorting garments.

SUMMARY

This Summary is provided to introduce a selection of concepts in a simplified form that are further described below in the Detailed Description of Illustrative Embodiments. This Summary is not intended to identify key features or essential features of the claimed subject matter, nor is it intended to be used to limit the scope of the claimed subject matter.

Disclosed herein is a clothing article sorting apparatus. The apparatus includes a panel that defines a channel extending therethrough and having a shoulder extending from a periphery of the channel and configured for receivably engaging an open end of a first article. The apparatus includes a first mode in which the shoulder receivably engages the open end of the first article and a second mode in which a second article is positioned proximal the first article and ingressed with the first article through the channel.

According to one or more embodiments, the panel is cylindrically shaped and the channel is defined through an inner and outer circumferential surface of the panel.

According to one or more embodiments, the panel is cylindrically shaped and the channel is formed on an end surface of the panel.

According to one or more embodiments, the panel is cylindrically shaped and the apparatus includes a container positioned proximal the panel.

According to one or more embodiments, the container is cylindrically shaped and includes a bottom panel for forming an enclosure and the panel is engaged with an upper portion of the container.

According to one or more embodiments, the panel is rotatable about the container.

According to one or more embodiments, the panel further defines a plurality of channels extending therethrough. Each channel has a shoulder extending from a periphery thereof and is configured for receivably engaging an open end of an article.

According to one or more embodiments, a sock sorting apparatus is provided. The apparatus includes a container having a bottom and a longitudinally extending sidewall extending therefrom and a cylindrically-shaped panel aligned and engaged with an upper portion of the container. The panel defines a radially extending channel having a shoulder extending from a periphery thereof and configured for receiving an open end of a first sock. A second sock is positioned proximal the first sock and inserted into and through the channel and disposed into the container.

According to one or more embodiments, the cylindrically-shaped panel is configured for rotatable movement about the container.

According to one or more embodiments, a sock sorting apparatus is provided. The apparatus includes a container having a bottom and a longitudinally extending sidewall extending therefrom and a panel positioned proximal the container and that includes a cylindrically shaped shoulder extending therefrom and defining a channel in alignment with the shoulder and that extends through the panel for allowing pass-through of a matched pair of socks. The cylindrically shaped shoulder is configured for receiving an open end of a first sock. A second sock is positioned proximal the first sock and inserted into and through a respective channel and disposed into the container.

According to one or more embodiments, a method for sorting and matching an article of clothing is provided. The method includes providing a panel that defines a channel extending therethrough and having a shoulder extending from a periphery of the channel and configured for receivably engaging an open end of a first article. The method includes positioning the open end of a first article into engagement with an outer surface of the shoulder. The method includes positioning a second article proximal the first article and ingressing the first article and the second article through the channel.

According to one or more embodiments, the apparatus includes a stand in engagement with the panel for supporting the panel above a surface.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the presently disclosed invention is not limited to the specific methods and instrumentalities disclosed. In the drawings.

DETAILED DESCRIPTION

The presently disclosed invention is described with specificity to meet statutory requirements. However, the description itself is not intended to limit the scope of this patent. Rather, the inventors have contemplated that the claimed invention might also be embodied in other ways, to include different steps or elements similar to the ones described in this document, in conjunction with other present or future technologies.

Figure 1:
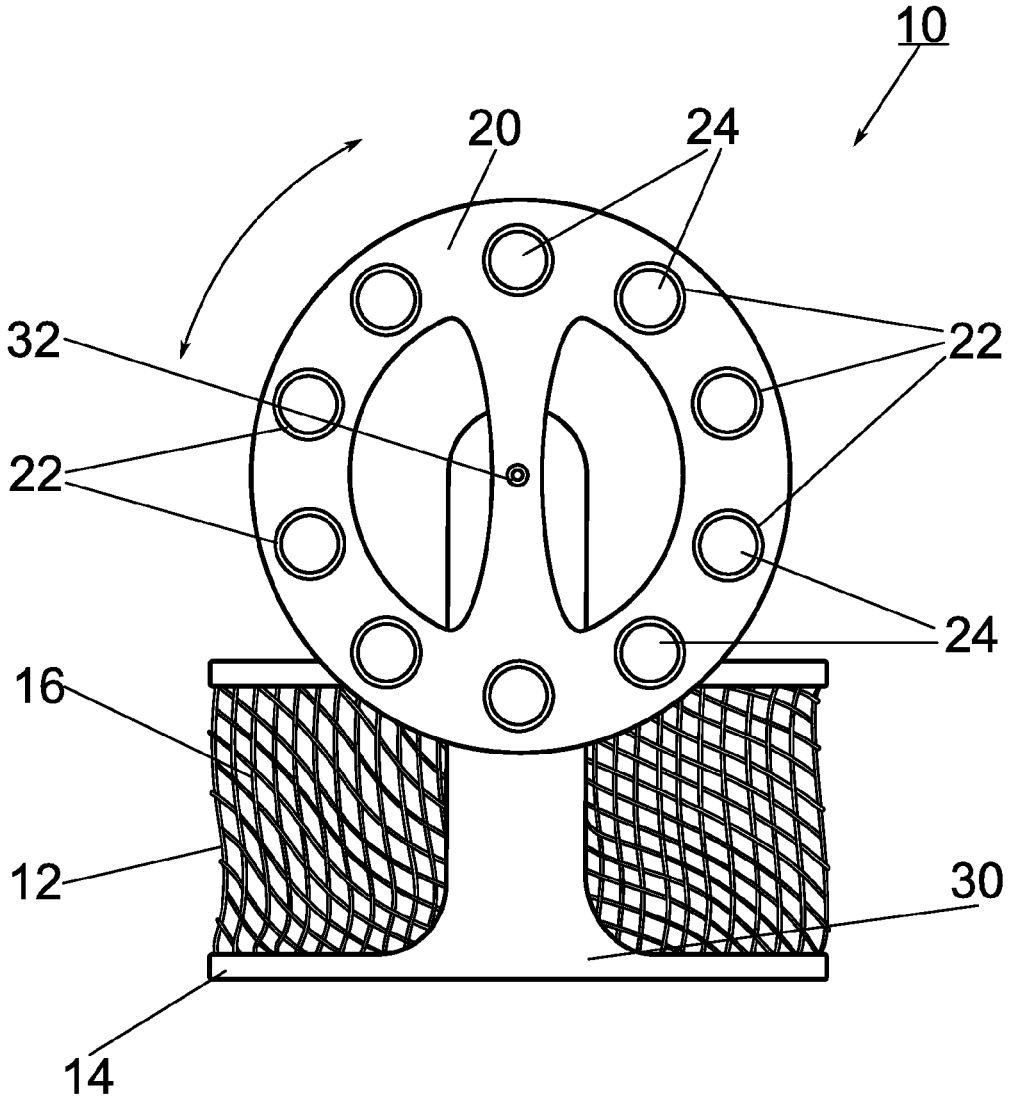
FIG. 1 is a front view of an article sorting apparatus according to one or more embodiments disclosed herein.
Figure 2:
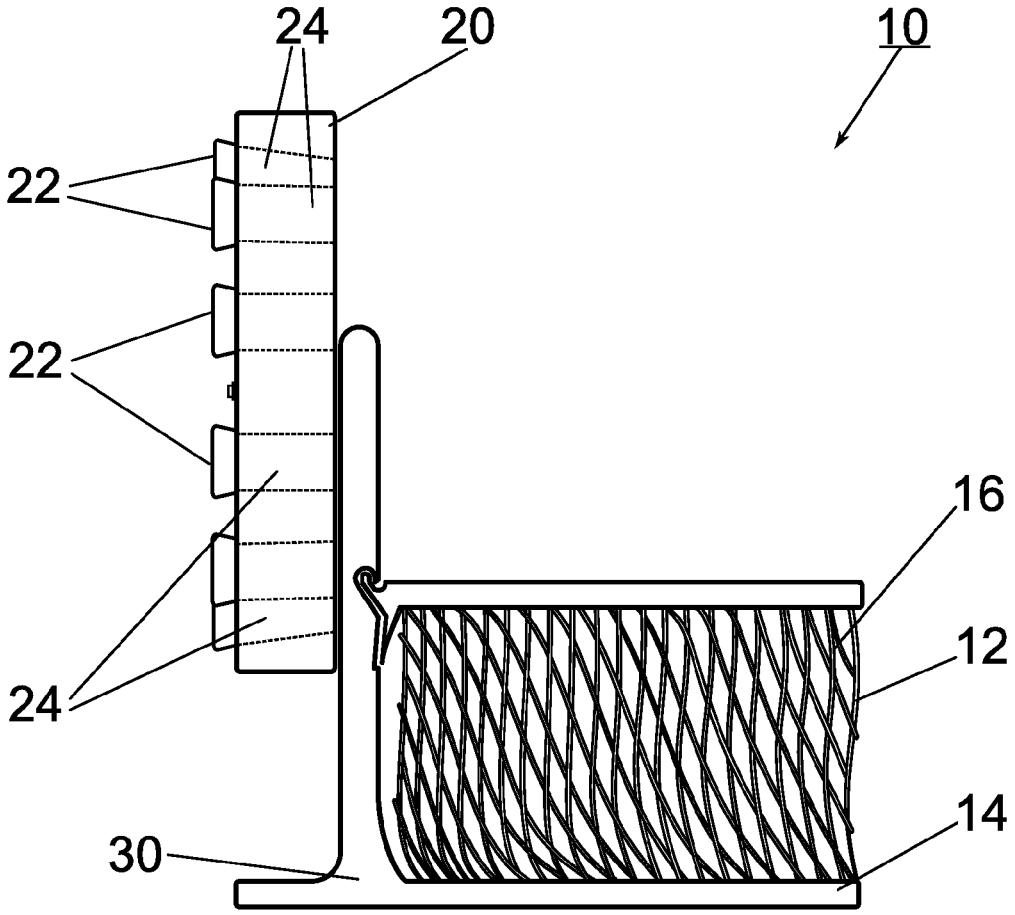
FIG. 2 is a side view of an article sorting apparatus according to one or more embodiments disclosed herein.

FIG. 1 illustrates an article sorting and matching apparatus according to one or more embodiments of the disclosed subject matter that is generally designated as 10 throughout FIGS. 1 through 3E. The apparatus 10 may include a container 12 having a bottom 14 and a longitudinally extending sidewall 16 extending from the bottom 14. The container 12 may be any appropriately configured container and may take on any desired shape or characteristic. For example, the container 12 is shown having a grid-like construction, but is not so limited. The container 12 may be made from any suitable material. Additionally, in one or more embodiments, the apparatus 10 may be configured for cooperating with a container according to containers known in the art, or may be configured for cooperating with a specifically configured container.

The apparatus 10 includes a panel 20 that may be positioned proximal the container 12. The panel 20 may include a cylindrically shaped shoulder 22 extending from a surface of the panel 20. The panel 20 may further define a channel 24 in alignment with the shoulder 22. The channel 24 extends through the panel 20 and allows pass-through of a matched pair of articles. In the one or more embodiments illustrated throughout the figures, the articles may be a garment or other clothing article such as a sock and/or pair of socks.

Figure 3A:
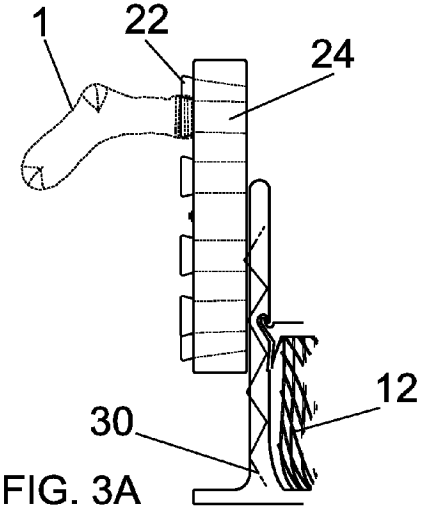
FIG. 3A is a partial side view of an article sorting apparatus having a first article in engagement with a shoulder extending from a panel of the article sorting apparatus according to one or more embodiments disclosed herein.
Figure 3C:
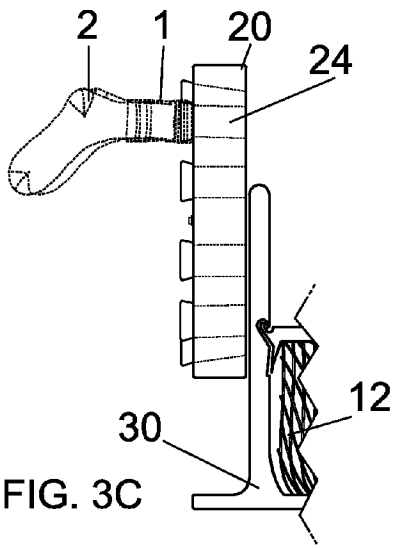
FIG. 3C is a partial side view of an article sorting apparatus having a first article in engagement with a shoulder extending from a panel of the article sorting apparatus and a second article positioned proximal the first article according to one or more embodiments disclosed herein.
Figure 3B:
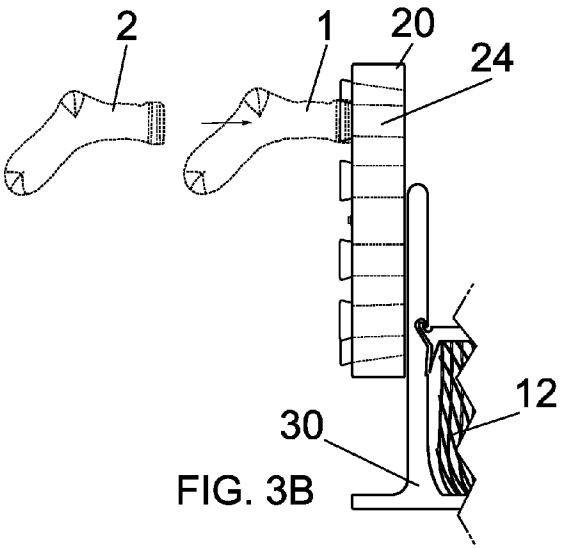
FIG. 3B is a partial side view of an article sorting apparatus having a first article in engagement with a shoulder extending from a panel of the article sorting apparatus and a second article positioned proximal the first article according to one or more embodiments disclosed herein.
Figure 3E:
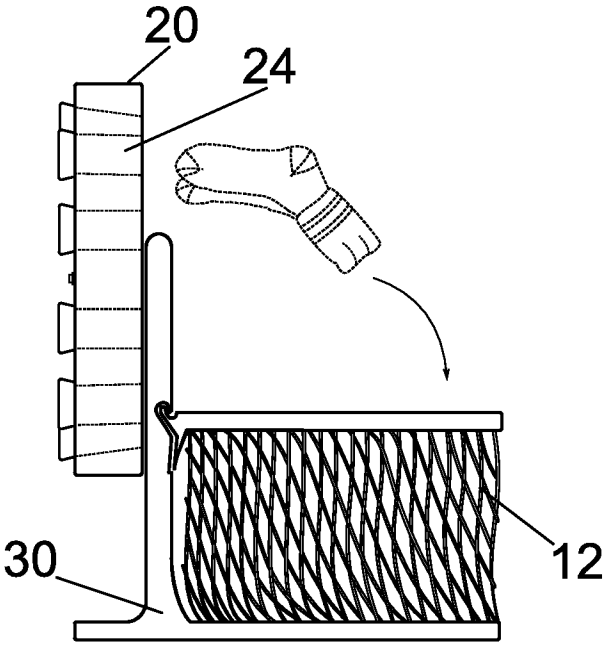
FIG. 3E is a partial side view of an article sorting apparatus in which a matching pair of articles have passed through the channel and are being disposed in a proximally positioned container according to one or more embodiments disclosed herein.
Figure 3D:
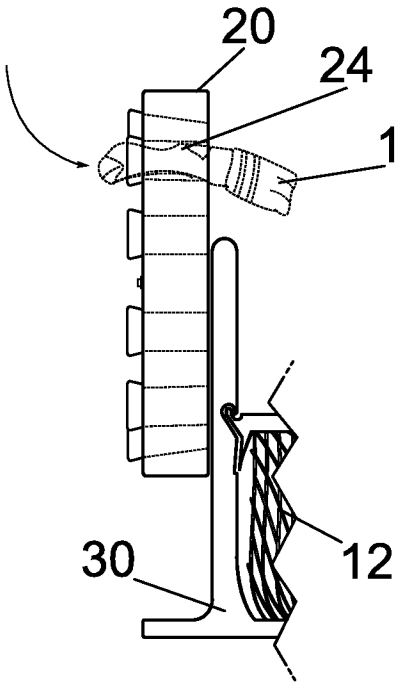
FIG. 3D is a partial side view of an article sorting apparatus having a first article in engagement with a shoulder extending from a panel of the article sorting apparatus and a second article in engagement with the first article to form a matching pair of articles and passing through a channel defined in the panel according to one or more embodiments disclosed herein.
Figure 4:
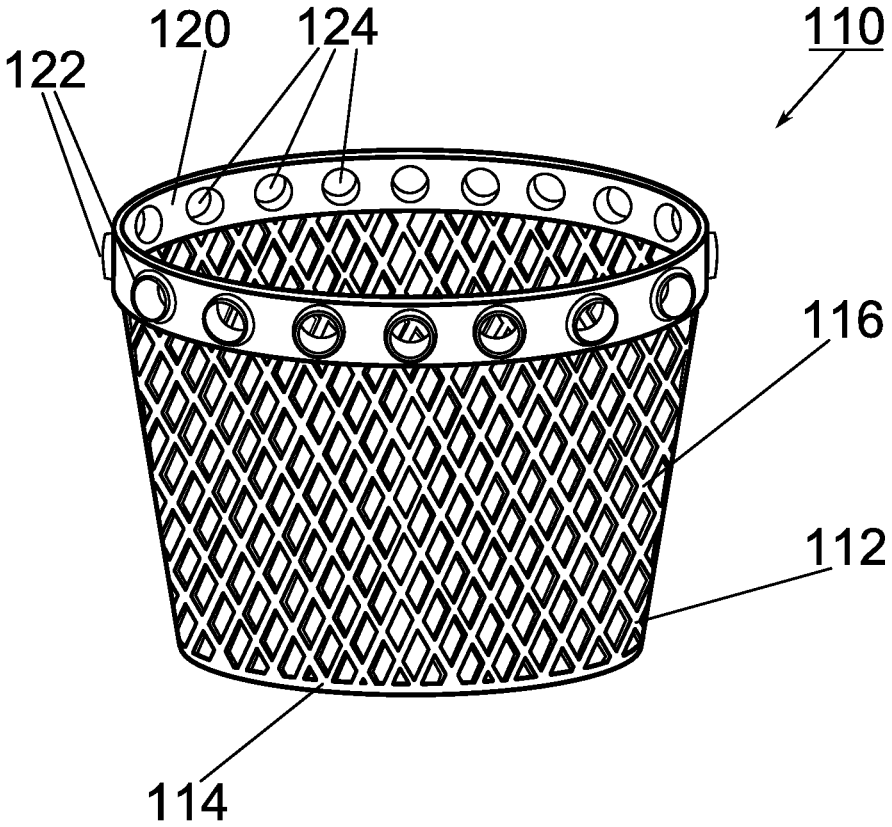
FIG. 4 is a perspective view of an article sorting apparatus according to one or more embodiments disclosed herein.

The cylindrically shaped shoulder 22 may be configured for receiving an open end of a first sock 1. As illustrated in FIG. 3A, the open end of the sock 1 is expanded to have a footprint larger than that of the cylindrically shaped shoulder 22 and the open end of the sock 1 is then positioned over the outer circumferential surface of the cylindrically shaped shoulder 22. The open end of the sock 1 is then released and, due to the elastic construction of the sock 1, the open end returns to an un-expanded footprint and into engagement with the cylindrically shaped shoulder 22.

A second sock 2 is positioned proximal the first sock 1 and the matched pair of the first sock 1 and the second sock 2 are inserted into and through a respective channel 24 as illustrated in FIGS. 3A through 3E and disposed into the container 12 in which each successive figure represents a successive step in using the apparatus 10 according to one or more embodiments illustrated herein. While a single first sock 1 is illustrated as being installed on one shoulder 22 in FIGS. 3A through 3E, the panel 20 may be configured to include a plurality of shoulders 22, with each shoulder 22 having a respective channel defined in the panel 20. In this manner, each of a plurality of socks may be engaged with each of a plurality of shoulders 22. Accordingly, a user of the apparatus 10 can select a plurality of non-matching socks to each engage shoulder 22. The remaining socks would then be matched to the matching sock in engagement with shoulder 22 according to the description in the prior paragraph.

The panel 20 may be cylindrically shaped as illustrated, or may take on any appropriately configured shape and configuration. The panel 20 may be carried by a stand 30 that has a rotatable pin 32 extending therefrom into the panel 20. Accordingly, the panel 20 illustrated throughout FIGS. 1 through 3E may be configured for rotatable movement. In this manner, the operator may rotate the panel 20 until a selected shoulder 22 and sock are in a desired position.

An article sorting apparatus according to one or more embodiments is illustrated in FIGS. 4 through 7 and is generally designated 110. The apparatus 110 shares many features and aspects as apparatus 10 illustrated in the one or more embodiments illustrated in FIGS. 1 through 3E. The apparatus 110 may include a container 112 having a bottom 114 and a longitudinally extending sidewall 116 that extends from the bottom 114. The apparatus 110 may include a cylindrically-shaped panel 120 that is aligned and engaged with an upper portion of the container 112. The panel 112 may define a channel 124 that has a shoulder 122 extending from a periphery of the channel 124. Similar to shoulder 22 illustrated in the one or more embodiments illustrated in FIGS. 1 through 3E, the shoulder 122 is configured for receiving an open end of a first sock 1.

The panel 120 may be configured for rotatable movement about the container 112. In this manner, the operator may rotate the panel 120 until a selected shoulder 122 and sock are in a desired position. The panel 120 or the container 112 may have a roller ball or roller bearing assembly for providing for rotatable movement of the panel 120 about the container 112.

Figure 5:
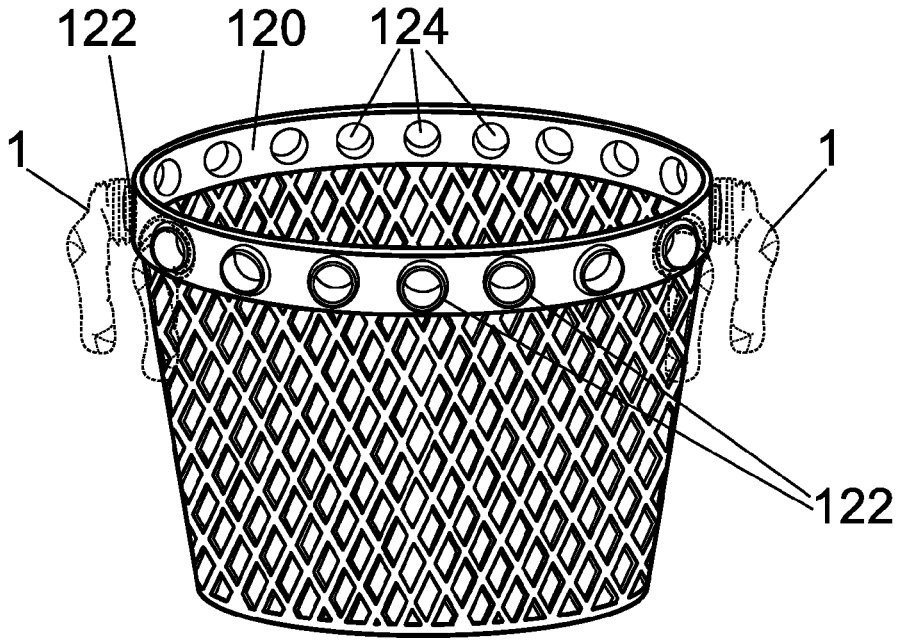
FIG. 5 is a perspective view of an article sorting apparatus having a first sock installed thereon according to one or more embodiments disclosed herein.
Figure 6:
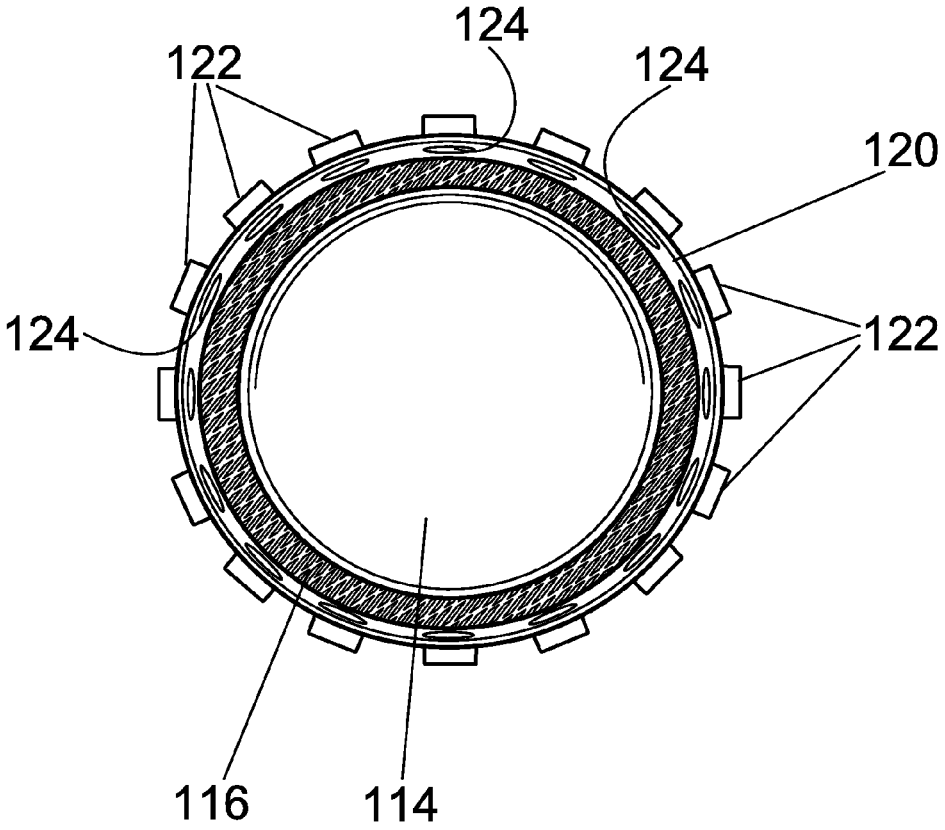
FIG. 6 is a top view of an article sorting apparatus according to one or more embodiments disclosed herein.
Figure 7:
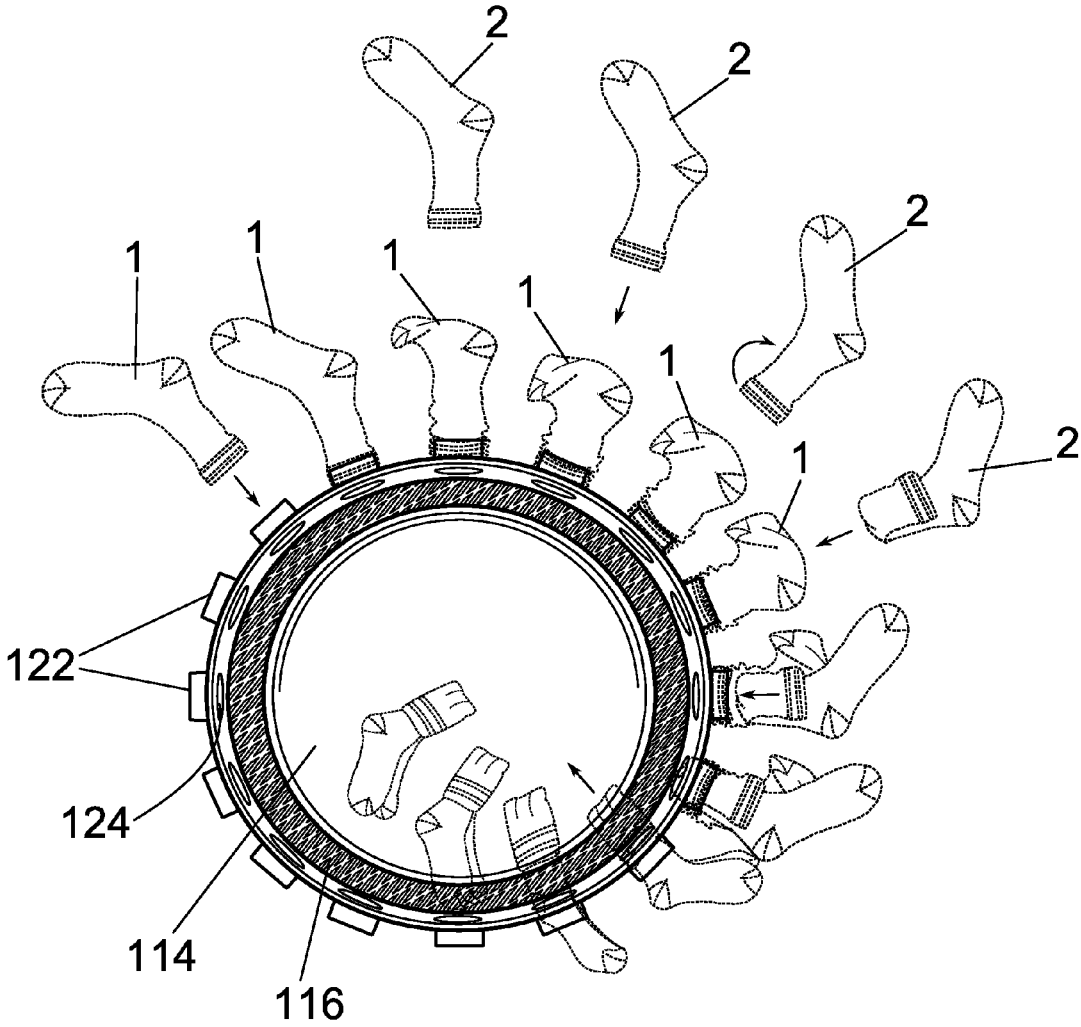
FIG. 7 is a top view of an article sorting apparatus having a plurality of socks installed thereon, each sock being installed on a respective shoulder, and each successive sock shown in a clockwise direction being representative of a successive step of using the apparatus according to one or more embodiments disclosed herein.

As illustrated in FIG. 7, in this manner, each sock of a plurality of socks are engaged with a respective shoulder 122. The open end of each sock 1 is expanded to have a footprint larger than that of the cylindrically shaped shoulder 122 and the open end of the sock 1 is then positioned over the outward circumferential surface of the cylindrically shaped shoulder 122. The open end of the sock 1 is then released and the open end returns to an un-expanded footprint and into engagement with the cylindrically shaped shoulder 122. A second sock 2 is positioned proximal the first sock 1 and a matched pair of the first sock 1 and the second sock 2 are inserted into and through a respective channel 124 as illustrated in FIGS. 5 through 7 and disposed into the container 112. As illustrated, each successive sock in a clockwise direction represents a successive step in using the apparatus 110 according to one or more embodiments illustrated herein.

Each of shoulders 22 and 122 may take on any appropriately configured shape or size to fit a desired garment or article of any shape or size.

While the embodiments have been described in connection with the preferred embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed:

1. A clothing article sorting apparatus comprising:

a panel that defines a channel extending therethrough and having a shoulder extending from a periphery of the channel and configured for receivably engaging an open end of a first article, wherein the apparatus includes a first mode in which the shoulder receivably engages the open end of the first article and a second mode in which a second article is positioned proximal the first article and ingressed with the first article through the channel;

wherein the container is cylindrically shaped and comprises a bottom panel for forming an enclosure, and further wherein the panel is engaged with an upper portion of the container and the panel is rotatable about the container.

2. The article sorting apparatus according to claim 1, wherein the panel is cylindrically shaped and the channel is defined through and inner and outer circumferential surface of the panel.

3. The article sorting apparatus according to claim 1, wherein the panel is cylindrically shaped and the channel is formed on an end surface of the panel.

4. The article sorting apparatus according to claim 1, wherein the panel is cylindrically shaped, and further wherein, the apparatus comprises a container positioned proximal the panel.

5. The article sorting apparatus according to claim 1, wherein the panel further defines a plurality of channels extending therethrough, each channel having a shoulder extending from a periphery thereof and configured for receivably engaging an open end of an article.

6. A sock sorting apparatus comprising:

a container having a bottom and a longitudinally extending sidewall extending therefrom; and a cylindrically-shaped panel aligned and engaged with an upper portion of the container, the panel defining a radially extending channel having a shoulder extending from a periphery thereof and configured for receiving an open end of a first sock, whereby a second sock is positioned proximal the first sock and inserted into and through the channel and disposed into the container;

wherein the cylindrically-shaped panel is configured for rotatable movement about the container.

7. A sock sorting apparatus comprising:

a container having a bottom and a longitudinally extending sidewall extending therefrom; and a panel positioned proximal the container and that includes a cylindrically shaped shoulder extending therefrom and defining a channel in alignment with the shoulder and that extends through the panel for allowing pass-through of a matched pair of socks, wherein the cylindrically shaped shoulder is configured for receiving an open end of a first sock, whereby a second sock is positioned proximal the first sock and inserted into and through a respective channel and disposed into the container;

wherein the panel is cylindrically shaped and the channel is formed on a surface of the panel, wherein the container is cylindrically shaped and the panel is engaged with an upper portion of the container, and the panel is rotatable about the container.

8. The sock sorting apparatus according to claim 7, wherein the panel is cylindrically shaped and the channel is defined in a circumferentially extending surface of the panel.

9. The article sorting apparatus according to claim 7, wherein the panel further defines a plurality of cylindrically shaped shoulders extending therefrom, each respective shoulder defining a channel in alignment therewith for allowing pass-through of a matched pair of socks.

10. The article sorting apparatus according to claim 7, further including a stand in engagement with the panel for supporting the panel above a surface.

11. A clothing article sorting apparatus comprising:

a panel that defines a channel extending therethrough and having a shoulder extending from a periphery of the channel and configured for receivably engaging an open end of a first article, wherein the apparatus includes a first mode in which the shoulder receivably engages the open end of the first article and a second mode in which a second article is positioned proximal the first article and ingressed with the first article through the channel; and wherein the panel further defines a plurality of channels extending therethrough, each channel having a shoulder extending from a periphery thereof and configured for receivably engaging an open end of an article.

12. The article sorting apparatus according to claim 11, wherein the panel is cylindrically shaped and the channel is defined through and inner and outer circumferential surface of the panel.

13. The article sorting apparatus according to claim 11, wherein the panel is cylindrically shaped and the channel is formed on an end surface of the panel.

14. The article sorting apparatus according to claim 11, wherein the panel is cylindrically shaped, and further wherein, the apparatus comprises a container positioned proximal the panel.

15. The article sorting apparatus according to claim 14, wherein the container is cylindrically shaped and comprises a bottom panel for forming an enclosure, and further wherein the panel is engaged with an upper portion of the container.

16. The article sorting apparatus according to claim 15, wherein the panel is rotatable about the container.

* * * * *